US006196382B1

(12) United States Patent
Lenderman

(10) Patent No.: US 6,196,382 B1
(45) Date of Patent: Mar. 6, 2001

(54) CIGARETTE LIGHTER HOLDER

(76) Inventor: Ronald Lenderman, 4019 Harvest Meadow Dr., St. Peters, MO (US) 63376

( * ) Notice: Subject to any disclaimer, the term of this patent is extended or adjusted under 35 U.S.C. 154(b) by 0 days.

(21) Appl. No.: 09/313,561

(22) Filed: May 15, 1999

(51) Int. Cl.[7] ..... A24F 19/00
(52) U.S. Cl. ..... 206/37; 206/38
(58) Field of Search ..... 206/37, 38, 234, 206/477, 478, 87

(56) References Cited

U.S. PATENT DOCUMENTS

| | | | | |
|---|---|---|---|---|
| D. 259,063 | | 4/1981 | Manikas . | |
| D. 376,871 | | 12/1996 | Sanchez et al. . | |
| D. 378,440 | | 3/1997 | Collette . | |
| 3,057,464 | * | 10/1962 | Baggott, Sr. | 206/37 |
| 4,176,773 | | 12/1979 | Wilkinson . | |
| 4,833,902 | * | 5/1989 | Mori | 206/38 X |
| 4,854,856 | * | 8/1989 | Steiger, Jr. H. M. et al. | 206/234 X |
| 5,289,915 | * | 3/1994 | Queen | 206/37 |
| 5,740,905 | * | 4/1998 | Kilfoy | 206/37 |
| 5,794,767 | | 8/1998 | Wilson . | |
| 5,819,917 | * | 10/1998 | Nicholson | 206/37 |

* cited by examiner

*Primary Examiner*—David T. Fidei
(74) *Attorney, Agent, or Firm*—Polster, Lieder, Woodruff & Lucchesi

(57) ABSTRACT

A cigarette lighter holder is made from a shell having a side wall and a bottom wall defining an upwardly opening chamber sized to slidably receive a cigarette lighter. A flexible rib within the chamber frictionally grasps the lighter to securely hold the lighter in the lighter holder. The rib can be formed on a sleeve in the chamber. A cord is mounted to the bottom of the shell, for example, by an eyelet secured to the shell bottom. The eyelet can be mounted to the shell bottom so that it can rotate relative to the shell. The cord is adapted to be secured to an article of clothing or a purse to help prevent loss of the holder and lighter if the user should accidentally drop the holder, with the lighter in it.

19 Claims, 1 Drawing Sheet

CIGARETTE LIGHTER HOLDER

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

This invention relates to cigarette lighter holders, and in particular, to a lighter holder which securely holds a cigarette lighter and can be clipped to one's clothing to avoid loss of the cigarette lighter.

Cigarette lighters are generally small. They are typically sized to fit in a shirt or pants pocket. When a cigarette lighter is in a pocket, it is generally loose in the pocket, and the lighter can work its way out of the pocket. This is especially true when the lighter is in a shirt pocket. When a person bends over, the lighter is apt to slide out of the pocket and are lost. Lighters are also often dropped, for example, in a crowd, when the user is jostled. When lighters are lost, the must be replaced.

Lighter holders have been designed. However, many do not securely hold the lighter, and the lighter can slide out of the holder. Additionally, many are not attachable to clothing. These lighter holders to not guard against loss of the lighter. Therefore, even when the lighter is in the holder, the lighter and its holder can be easily lost.

BRIEF SUMMARY OF THE INVENTION

Briefly stated, the cigarette lighter holder of the present invention is made from a shell having a side wall and a bottom wall defining an upwardly opening chamber sized to slidably receive a cigarette lighter and frictionally hold the lighter. A cord is mounted to the bottom of the shell, for example, by an eyelet secured to the shell bottom. The eyelet can be mounted to the shell bottom so that it can rotate relative to the shell. The cord can be secured to an article of clothing or a purse, for example by a clip at the end of the cord. Thus, if the user should accidentally drop the holder, with the lighter in it, the holder and lighter will not be lost. By attaching the cord to the bottom of the shell, rather than the side of the shell, the cord, and the eyelet to which the cord is attached, will not interfere with the user's grasp of the lighter holder and operation of the lighter.

To frictionally grip the lighter in the holder, the holder has at least one rib in the chamber. The chamber has a circumference larger than the circumference of the lighter and the rib has a circumference at least slightly smaller than the circumference of the lighter. Thus, the lighter will wipe against, and compress, the rib as the lighter is inserted in the lighter holder. The rib is made from a material, such as rubber or soft plastic, which will frictionally grip the lighter when the lighter is inserted in the lighter holder. Preferably, the rib is flexible so that as the lighter wipes against the rib, the rib bends downwardly. To facilitate this bending of the rib, the rib is triangular in cross-section and has a height which is greater than its base. The lighter holder has a sleeve which is received in the shell. The rib is formed or molded on the sleeve. Alternatively, the rib can be made as an O-ring which is received in a groove in the shell.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
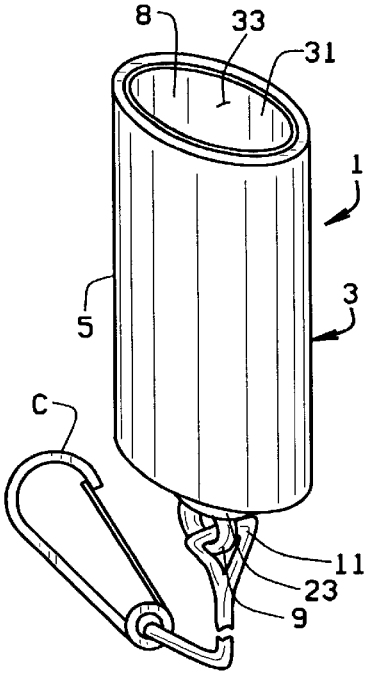
FIG. 1 is a perspective view of a cigarette lighter holder of the present invention.
Figure 2:
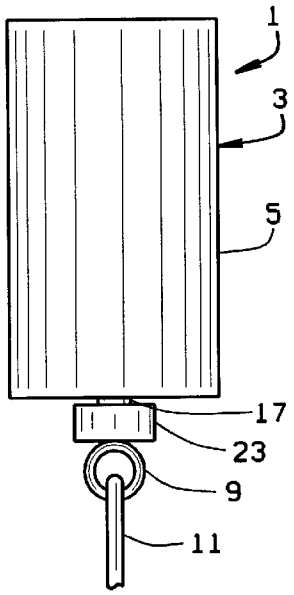
FIG. 2 is a front elevational view of the cigarette lighter holder.
Figure 3:
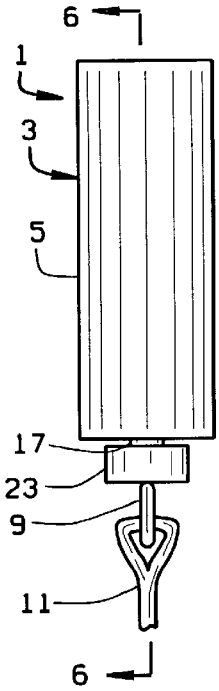
FIG. 3 is a side elevational view of the cigarette lighter holder.
Figure 4:
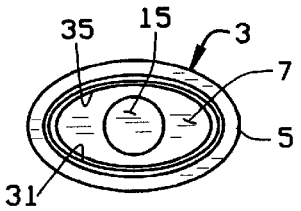
FIG. 4 is a top plan view of the cigarette lighter holder.
Figure 5:
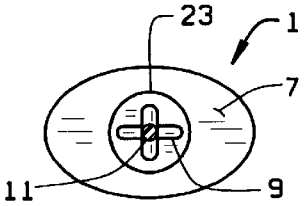
FIG. 5 is a bottom plan view of the cigarette lighter holder.

The following detailed description illustrates the invention by way of example and not by way of limitation. This description will clearly enable one skilled in the art to make and use the invention, and describes what I presently believe is the best mode of carrying out the invention.

A cigarette lighter holder 1 of the present invention is designed to securely hold a lighter L, so that the lighter cannot accidentally slip out of the lighter holder 1. The lighter L can only be removed from the lighter holder 1 by being pulled out of the holder. To help prevent an accidental loss of the lighter L, the lighter holder 1 is adapted to be secured to a user's clothing, or in a user's purse, or the like, as is described below. Thus, if the user should drop the lighter (which is in the holder), because the holder is secured to the user's clothing, purse, etc., the lighter will not be lost.

The cigarette lighter holder 1 includes an outer plastic shell 3 having a side wall 5 and a bottom 7 which, in combination, define an upwardly opening chamber 8. The shell 3 is shown to be generally oval in plan to correspond generally to the shape of a BIC® lighter. However, the shell 3 (and in particular, the outer surface of the shell) could have any other desired configuration (i.e., round, square, etc.). An eyelet 9 is mounted to the bottom 7 of the shell 3. A cord 11 is tied, or otherwise fixed, to the eyelet 9. The cord can be a any type of cord. For example, it can be a chain, a string or rope, or a stretchable cord The cord can have a clasp or clip C at its free end which will allow the user to attach the holder to his clothing. The clip C can be clipped to a belt loop of the wearer's pants, or, it could be clipped to a loop within a purse. With the clip attached to the user's apparel, purse, etc., if the user drops the holder, the holder (and hence the lighter within the holder) will not be lost. Because the cord 11 attaches to the bottom of the lighter holder 1, rather than to a side of the lighter holder, the cord will not interfere with a user's grasp of the lighter holder, and operation of the lighter contained within the lighter holder.

Figure 6:
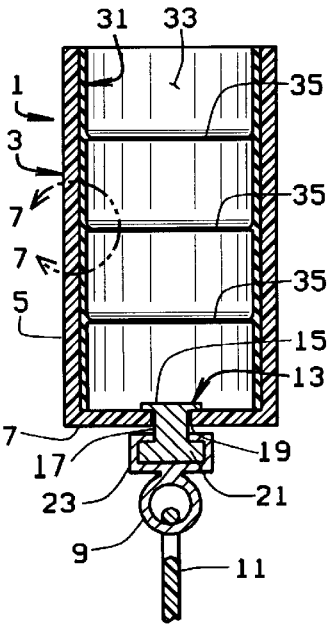
FIG. 6 is a cross-sectional view of the cigarette lighter holder taken along line 6—6 of FIG. 3.

Preferably, the eyelet 9 is mounted to the shell 3 so that it may rotate a full 360°. To do this, a button or rivet 13 is attached to the shell bottom 7. The rivet 13 includes an inner foot 15 which rests on an inner surface of the shell bottom 7, a stem 17 which extends through a hole 19 in the shell bottom, and a head 21 which is external of the shell bottom 7. The eyelet 9 includes a base 23 which, as seen in FIG. 6, wraps around the rivet head 21. The connection of the eyelet base 23 to the rivet head 21 is not tight, so that the base 23 (and hence the eyelet 9) can rotate or pivot relative the rivet head 21. Other means can also be used to mount the eyelet to the shell which will enable the eyelet 9 to rotate relative to the shell 3.

A thin rubber liner 31 lines the inner surface of the shell wall 5 and frictionally grasps the lighter L. The liner 31 does not cover the shell bottom 7, but could do so if desired. The inner surface 33 of the rubber liner 31 is designed to correspond substantially in shape to the outer surface of the lighter L. Thus, for example, BIC® lighters are generally oval in shape. Hence, the inner surface 33 of the rubber liner is generally oval in shape. However, the dimensions of the inner surface 33 are slightly larger than the dimensions of the lighter, to accommodate slight differences in lighter dimensions. For example, some lighters simply have a hard plastic housing. However, other lighters may include a decorative sleeve about the plastic housing. This sleeve, although very thin, increases the dimensions of the lighter, and can affect the ability of a holder to receive a lighter. Thus, for example, a holder which will frictionally grasp a paper covered lighter may not grasp a plain, uncovered lighter as well.

Figure 7:
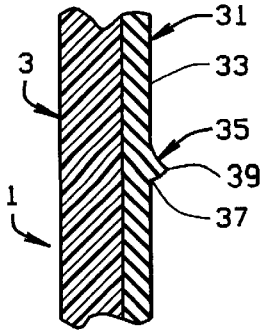
FIG. 7 is an enlarged, fragmentary cross-sectional view of the cigarette lighter holder taken along line 7—7 of FIG. 6 to show one of the internal ribs of the holder.
Figure 8:
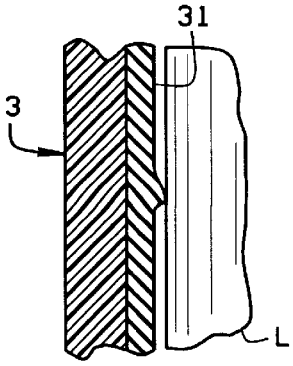
FIG. 8 is a view similar to FIG. 7, but showing the cigarette lighter in the cigarette lighter holder.

To overcome small dimensional differences in lighters, the liner 31 includes circumferential ribs 35. Three ribs 35 are shown and the ribs 35 are evenly spaced apart. More or fewer ribs could be provided. The ribs are preferably small, i.e. only about 1/16" to 1/8" from the rib base 37 to the rib top 39. As seen in FIG. 7, the rib 35 is generally triangular in cross-section. Preferably, the rib's height is greater than the rib's base, to make the rib flexible. The circumference of the rib 35 at its top 39 is slightly smaller than the circumference of the lighter L. As a consequence, as seen in FIG. 8, when the lighter L is inserted in the lighter holder 1, the lighter L will wipe against the rib 35, and the rib 35 will flex downwardly. The rib 35 will thus make a tight frictional contact with the lighter L. The frictional grip of the rib 35 against the lighter L is sufficiently strong that the lighter will not come out of the lighter holder 1 even when the lighter holder is swung around its cord 11. Thus, not even large centrifugal forces will overcome the grip of the ribs 35 on the lighter L. Therefore, the lighter L cannot be removed from the lighter holder 1 unless it is pulled from the lighter holder by the user. The lighter L will not accidentally fall out of the lighter holder 1.

Although the three ribs 35 are shown to be substantially the same size, they could be different sizes. For example, the ribs could increase in size from the top to the bottom rib. This would enable the lighter holder 1 to grasp a lighter which tapered from its top to its bottom.

The shell 3 is preferably made from plastic. The liner 31 is made from a flexible or compressible material, such as soft flexible plastic or a rubber The liner 31 and shell 3 can be co-molded together by known methods. Alternatively, the liner 31 can be molded separately from the shell 3, and inserted into the shell 3 in an assembly operation.

As various changes could be made in the above constructions without departing from the scope of the invention, it is intended that all matter contained in the above description or shown in the accompanying drawings shall be interpreted as illustrative and not in a limiting sense. For example, the ribs can be semi-circular, rather than triangular. If the ribs were semi-circular, then the rib would likely be compressed, rather than flexed, when the lighter is inserted in the lighter holder. However, the ribs would still frictionally grasp the lighter to prevent the lighter from accidentally coming out of the holder 1. The lining 31 can be omitted, and the ribs 35, which grasp the lighter, can be formed directly on the inside of the shell 3, either by co-molding or by positioning O-rings along the inner surface of the holder shell. The eyelet 9 can be made to be stationary. If it is stationary, then it can be molded as part of the holder shell 3 to be integral with the shell 3. The rivet head 21 to which the eyelet is rotatably mounted could be molded as a button extending from the bottom 7 of the shell 3. These examples are merely illustrative.

What is claimed is:

1. A cigarette lighter holder for holding a cigarette lighter, the lighter having a wall defining an outer dimension; the holder comprising a unitary, one-piece shell having a side wall and a bottom wall defining an opened chamber sized to slidably and frictionally receive a cigarette lighter; at least one pliable projection on an inner surface of said shell wall, said wall having an inner dimension greater than the outer dimension of said lighter, and said projection defining an inner dimension smaller than the outer dimension of the lighter wall, said projection being having a high coefficient of friction, said projection being deformed when the cigarette lighter is placed in said holder to frictionally grip the cigarette holder; and a cord mounted to the bottom of the shell, the cord being adapted to be securable to an article of clothing or a purse.

2. The cigarette lighter holder of claim 1 including an eyelet mounted to the bottom surface of the shell; the cord being fixed to the eyelet.

3. The cigarette lighter holder of claim 2 wherein the eyelet is rotatable relative to the housing bottom.

4. The cigarette lighter holder of claim 1 wherein the projection is flexible; whereby said lighter wipes against said projection and bends said rib toward said bottom wall when said lighter is inserted in the lighter holder.

5. The cigarette lighter holder of claim 1 wherein the at least one projection is generally triangular in cross-section.

6. The cigarette lighter holder of claim 5 wherein the at least one projection has a base and a height, the height of the rib being greater than the base of the rib.

7. The cigarette lighter holder of claim 1 including a sleeve received in the shell; said at least one projection being molded as a part of said sleeve.

8. A cigarette lighter holder for holding a cigarette lighter having a wall, the holder comprising a shell having a side wall and a bottom wall defining an opened chamber sized to slidably receive a cigarette lighter; and at least one pliable, rubber rib in said chamber; said chamber having a circumference larger than the circumference of the lighter, said rib having a circumference at least slightly smaller than the circumference of the lighter; the lighter engaging the pliable, rubber rib when placed in the holder to deform the rib while said lighter is in said holder; said rib frictionally griping the lighter when the lighter is in the lighter holder.

9. The cigarette lighter holder of claim 8 wherein the rib is flexible; whereby said lighter wipes against said rib and bends said rib downwardly when said lighter is inserted in the lighter holder.

10. The cigarette lighter holder of claim 9 wherein the at least one rib is generally triangular in cross-section.

11. The cigarette lighter holder of claim 10 wherein the at least one rib has a base and a height, the height of the rib being greater than the base of the rib.

12. The cigarette lighter holder of claim 9 including a sleeve received in the shell; said at least one rib being molded as part of said sleeve.

13. In combination, a cigarette lighter and a cigarette lighter holder; the cigarette lighter having a wall, the holder comprising:

shell having a side wall and a bottom wall defining an upwardly opening chamber sized to slidably receive a cigarette lighter, said chamber having a circumference larger than the circumference of the lighter;

at least one annular rib in said chamber spaced below an upper edge of said chamber; said rib having a circumference at least slightly smaller than the circumference of the lighter and being made from a pliable material which will deform when the lighter is received in the holder and which will frictionally grip the lighter when the lighter is in the lighter holder; and a cord mounted to the bottom of the shell, the cord being adapted to be securable to an article of clothing or a purse.

14. The combination of claim 13 including an eyelet mounted to the bottom surface of the shell; the cord being fixed to the eyelet; the eyelet being rotatable relative to the housing bottom.

15. The combination of claim 13 further including a sleeve received in the shell; said at least one rib being formed on said sleeve.

16. The combination of claim 13 wherein the rib is flexible; whereby said lighter wipes against said rib and bends said rib downwardly when said lighter is inserted in the lighter holder.

17. The combination of claim 16 wherein the at least one rib has a base and a height, the height of the rib being greater than the base of the rib.

18. The cigarette lighter holder of claim 1 including two or more pliable ribs, said ribs being evenly and axially spaced apart along the inner surface of said chamber wall.

19. The cigarette lighter holder of claim 7 wherein said sleeve and at least one rib are a unitary, one-piece member being made from a material different from the shell.

* * * * *

UNITED STATES PATENT AND TRADEMARK OFFICE

CERTIFICATE OF CORRECTION

PATENT NO. : 6,196,382 B1
DATED : March 6, 2001
INVENTOR(S) : Lenderman

It is certified that error appears in the above-identified patent and that said Letters Patent is hereby corrected as shown below:

Column 1,
Line 22, replace "the" with -- they --

Signed and Sealed this

Eighth Day of January, 2002

*Attest:*

*Attesting Officer*

JAMES E. ROGAN
*Director of the United States Patent and Trademark Office*